US008570137B2

(12) United States Patent
Pan

(10) Patent No.: US 8,570,137 B2
(45) Date of Patent: Oct. 29, 2013

(54) TRANSFORMER HAVING LAMINAR TYPE ON LOW VOLTAGE SIDE

(75) Inventor: Cheng-Yu Pan, New Taipei (TW)

(73) Assignee: Yujing Technology Co., Ltd, New Taipei (TW)

( * ) Notice: Subject to any disclaimer, the term of this patent is extended or adjusted under 35 U.S.C. 154(b) by 0 days.

(21) Appl. No.: 13/195,754

(22) Filed: Aug. 1, 2011

(65) Prior Publication Data

US 2012/0032769 A1 Feb. 9, 2012

(30) Foreign Application Priority Data

Aug. 3, 2010 (TW) ..... 99214850 U

(51) Int. Cl.
*H01F 27/30* (2006.01)

(52) U.S. Cl.
USPC ..... 336/198

(58) Field of Classification Search
USPC ..... 336/65, 83, 196, 192, 198, 200, 232, 336/220–223
See application file for complete search history.

(56) References Cited

U.S. PATENT DOCUMENTS

| | | | | |
|---|---|---|---|---|
| 6,518,870 | B2 * | 2/2003 | Yeh et al. | 336/198 |
| 6,522,233 | B1 * | 2/2003 | Kyoso et al. | 336/200 |
| 6,727,793 | B2 * | 4/2004 | Piechnick | 336/198 |
| 7,439,838 | B2 * | 10/2008 | Chen et al. | 336/198 |
| 7,612,644 | B2 * | 11/2009 | Hsu et al. | 336/198 |
| 8,049,590 | B2 * | 11/2011 | Huh et al. | 336/208 |
| 8,179,222 | B2 * | 5/2012 | Lee et al. | 336/208 |

* cited by examiner

*Primary Examiner* — Tuyen Nguyen
(74) *Attorney, Agent, or Firm* — Lowe Hauptman & Ham, LLP

(57) ABSTRACT

A transformer includes high and low voltage side parts. The high voltage side part includes a first base seat, a first isolator seat having a plurality of isolator grooves, and a plurality of coil sets. The first isolator seat has one end connect to the first base seat and another end with a positioning groove. The plurality of coil sets are wound around the first isolator seat, and are positioned in the plurality of isolator grooves. The low voltage side part includes a second base seat, a second isolator seat, and a plurality of sheet bodies. The second isolator seat has one end connected to the second base seat and another end defining a central column. The central column is positioned in the positioning groove. Each sheet body possesses an opening for containing the central column. The sheet bodies are mutually laminated and interlaced on the central column.

7 Claims, 5 Drawing Sheets

TRANSFORMER HAVING LAMINAR TYPE ON LOW VOLTAGE SIDE

BACKGROUND OF THE INVENTION

1. Field of the Invention

The invention relates to a transformer having laminar type on low voltage side, and more particularly, to a transformer structure having laminar type on low voltage side by using a plurality of laminar sheets that are mutually laminated and interlaced on a central column.

2. Description of the Prior Art

Since the high technology in the field of microelectronics advances with giant stride, the relevant manufacturing process changes with each passing day, and the electronic products, having deepened into each family and all walks of life, become indispensable part in modern life.

In general, the input voltage is either 110V or 220V in our daily life. This kind of high voltage oftentimes would damage the electronic products. Since all the electronic relevant products need an output voltage to perform operation, we all need to use a transformer to lower the high voltage while the electronic products are used.

A common transformer on the market all has a high voltage side part and a low voltage side part and both of them have coils wound by a plurality of twisted enamel wires. The high voltage side part has a plurality of leads soldered on a substrate by copper material. On the other hand, the low voltage side part is loaded by low voltage but high current, its enamel wires are relatively large in diameter as comparing with those of the high voltage side part, thereby, the loss due to Eddy current is relatively high too. In addition, the coils on the high voltage side part occupy a fairly large space that leads to relatively bigger overall size of the transformer.

Therefore, just how to design a low voltage side part to save the space and lower the Eddy loss to overcome the above-mentioned shortcomings become necessary in the industry.

SUMMARY OF THE INVENTION

In light of the above-mentioned disadvantages of the prior art, the invention provides a transformer having laminar type on low voltage side that is capable of overcoming the shortcomings of the prior art, satisfying the requirements of the industry, as well as improving the competitiveness in the market. It aims to ameliorate at least some of the disadvantages of the prior art or to provide a useful alternative.

The primary objective of the invention is to provide a transformer having laminar type on low voltage side by employing a plurality of thin copper sheets that are mutually laminated and interlaced on the central column to overcome the shortcomings of the prior art, satisfy the requirements of the industry, as well as to strengthen the competitiveness in the market.

To achieve the above-mentioned objective, a transformer having laminar type on low voltage side is provided. The transformer includes a high voltage side part and a low voltage side part. The high voltage side part further includes a first base seat, a first isolator seat having a plurality of isolator grooves (123), and a plurality of coil sets. The first isolator seat has its one end connect to the first base seat while has its other end surface possess a positioning groove. The plurality of coil sets are wound around the first isolator seat, are corresponding to and are positioned in the plurality of isolator grooves 21. The low voltage side part further includes a second base seat, a second isolator seat having a central column, and a plurality of sheet body. The second isolator seat has its one end that is connected to the second base seat. The central column has its one end surface position at the positioning groove. Each of the sheet body possesses an opening for containing the central column. The plurality of sheet bodies are mutually laminated and interlaced on the central column.

The accomplishment of this and other objectives of the invention will become apparent from the following description and its accompanying drawings of which:

DETAILED DESCRIPTION OF THE PREFERRED EMBODIMENT

Figure 1A:
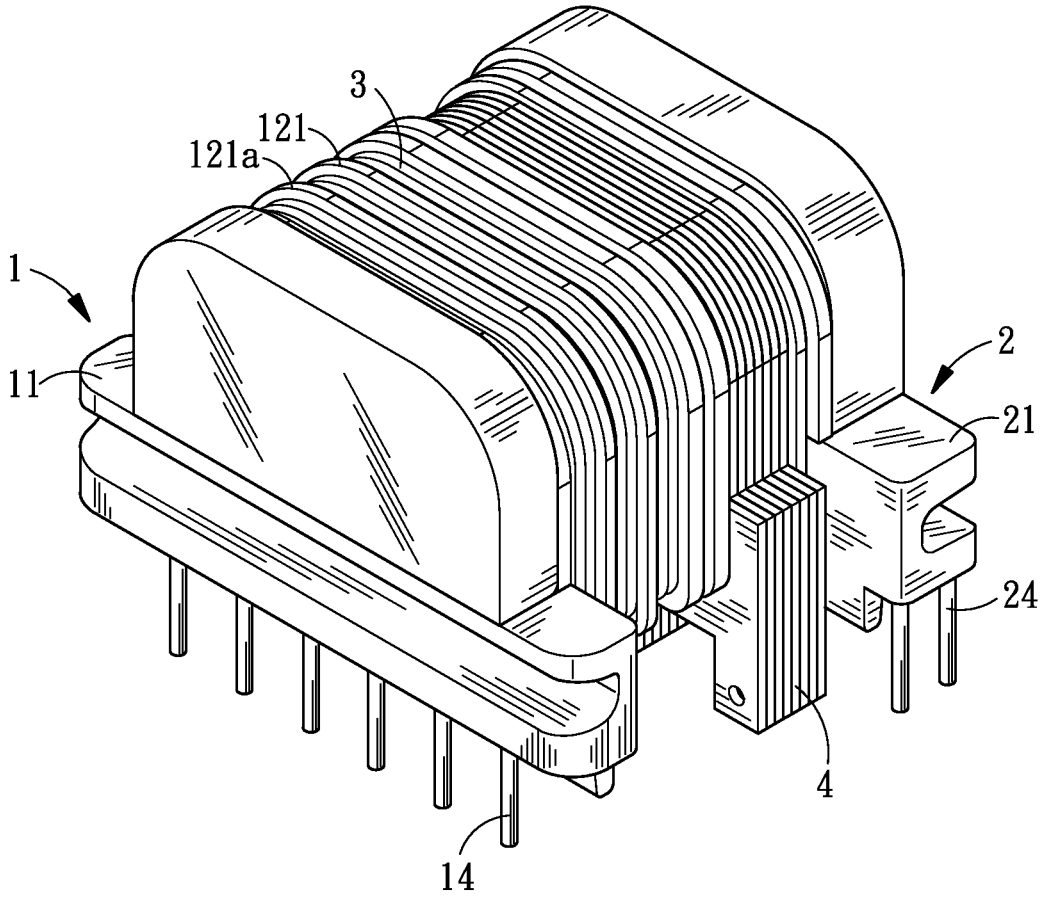
FIG. 1A is an isometric view showing the structure of the transformer having laminar type on low voltage side of a preferred embodiment of the invention.
Figure 1B:
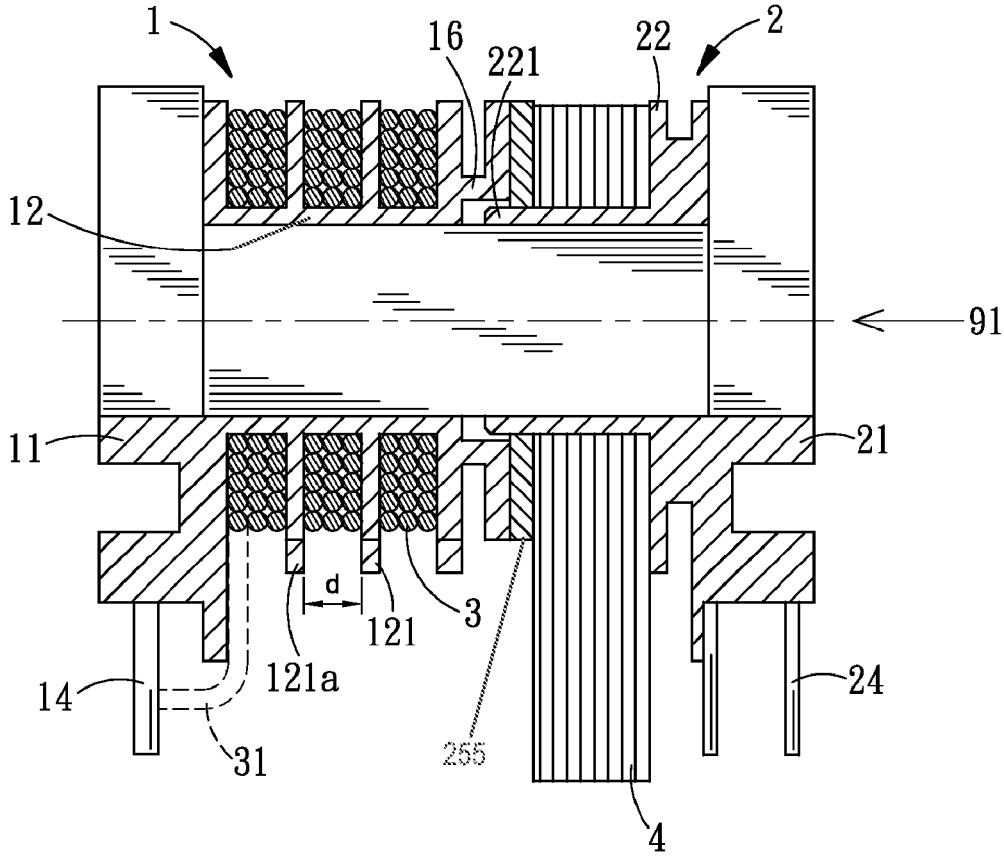
FIG. 1B is a cross-sectional side view of the transformer having laminar type on low voltage side of a preferred embodiment of the invention.
Figure 2A:
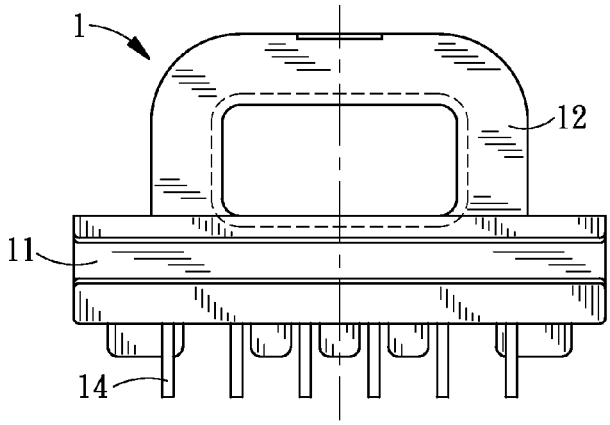
FIG. 2A is a front view showing the high voltage side part of the transformer having laminar type on low voltage side of a preferred embodiment of the invention.
Figure 2B:
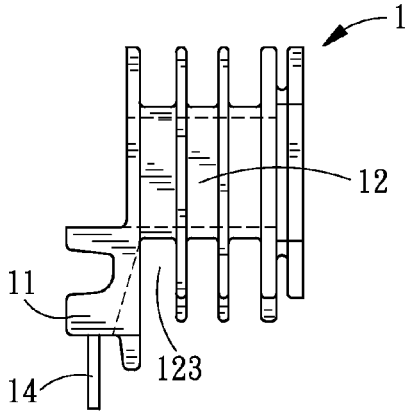
FIG. 2B is a side view showing the high voltage side part of the transformer having laminar type on low voltage side of a preferred embodiment of the invention.
Figure 2C:
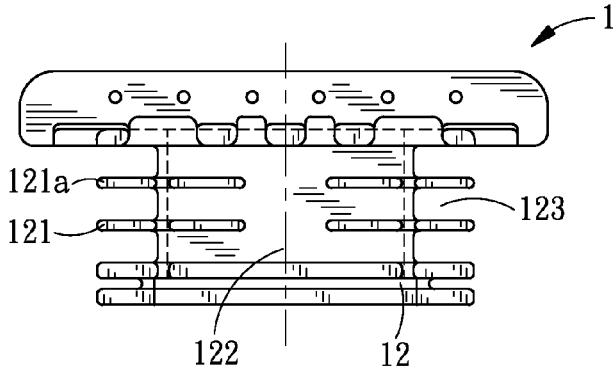
FIG. 2C is a bottom view showing the high voltage side part of the transformer having laminar type on low voltage side of a preferred embodiment of the invention.
Figure 3A:
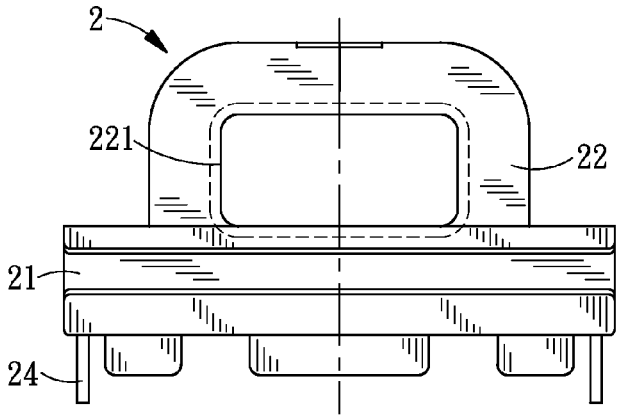
FIG. 3A is a front view showing the low voltage side part of the transformer having laminar type on low voltage side of a preferred embodiment of the invention.
Figure 3B:
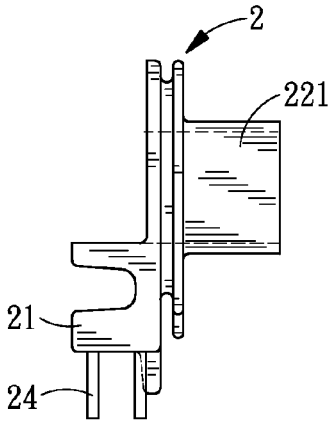
FIG. 3B is a side view showing the low voltage side part of the transformer having laminar type on low voltage side of a preferred embodiment of the invention.
Figure 3C:
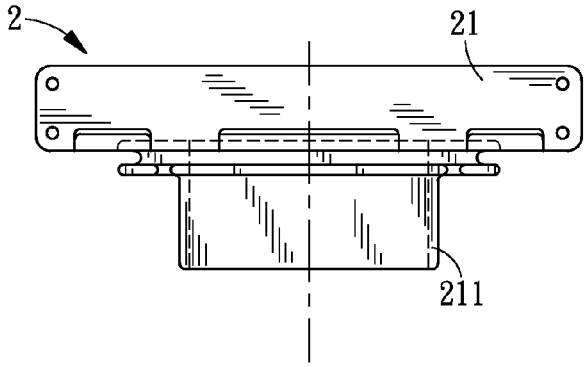
FIG. 3C is a bottom view showing the low voltage side part of the transformer having laminar type on low voltage side of a preferred embodiment of the invention.
Figure 4:
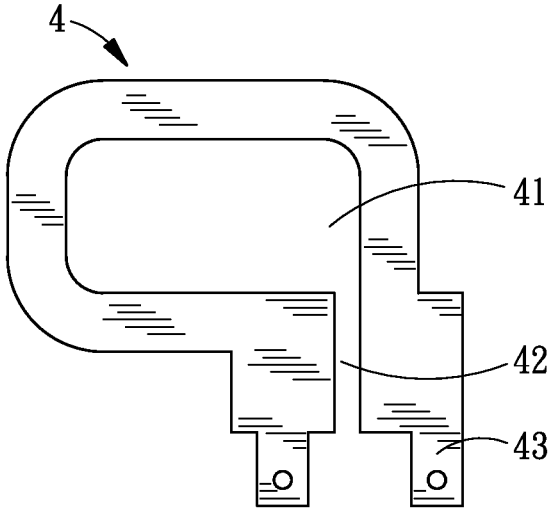
FIG. 4 is a schematic front view of the laminar sheet structure of the transformer having laminar type on low voltage side of a preferred embodiment of the invention.

As shown in FIG. 1A through FIG. 4, the transformer having laminar type on low voltage side of a preferred embodiment of the invention includes a high voltage side part (1) and a low voltage side part (2). The high voltage side part (1) has a first base seat (11), a first isolator seat (12), and a plurality of coil sets (3). The first isolator seat (12) is combined with the first base seat (11) along an axial direction (91) making not only an end surface of the first isolator seat (12) connect to the first base seat (11) but also the other end surface of which has a positioning groove (16). The first base seat (11) further possesses a plurality of first leads (14), and the directions of the extension of those, being the connecting directions between the first isolator seat (12) and the first base seat (11), are perpendicular to the axial direction (91).

In the preferred embodiment of the invention, the first isolator seat (12) has a plurality of isolators (121), and by the use of the separation of these, the isolator seat (12) is formed into a plurality of isolator grooves (123). Each of the isolator (121) further possesses at least an open channel (122) that is positioned between two isolator grooves (123) and that is communicated between them. There is a distance "d" between each of the isolator (121) and another isolator (121*a*) since they are all parallel to the first base seat (11).

The coil set (3) is formed by enamel covered wire, wound around the first isolator seat (12), corresponding to and positioned at the plurality of isolator grooves (123) respectively. As the plurality of open channels (122) is arranged in a row to form the axial direction (91), all the coil sets (3) pass the open channel (122). The end of the coil sets (3) forms a plurality of coil ends (31) connected to the first leads (14) by tin soldering. The "TRANSFORMER HAVING LAMINAR TYPE ON THE LOW VOLTAGE SIDE" of the invention employs copper brazing to attach to the circuit substrate (not shown in the FIG.) through the first lead (14).

In the preferred embodiment of the invention, the low voltage side part (2) further includes a second base seat (21), a second isolator seat (22) having a central column (221), and a plurality of sheet body (4). The second isolator seat (22) combines with the second base seat (21) along the axial direction (91). Moreover, an end surface of the second isolator seat (22) is connected to the second base seat (21) making an end surface of the central column (221) position in the positioning groove (16). Both the first isolator seat (12) and the second isolator seat (22) are made of non-electrically-conductive material. What is more, along the axial direction (91), the low voltage side part (2) is capable of performing linear displacement motion to adjust, by a spacer (255), the spacing between the low voltage side part (2) and the high voltage side part (1) for providing the room for placing various number of sheet bodies (4). In addition, the second base seat (21) further possesses a plurality of second lead (24), and the directions of the extension of those, being the connecting directions between the second isolator seat (22) and the second base seat (21), are perpendicular to the axial direction (91). The "TRANSFORMER HAVING LAMINAR TYPE ON THE LOW VOLTAGE SIDE" of the invention employs copper brazing to attach to the circuit substrate (not shown in the FIG.) through the second lead (24).

In the preferred embodiment of the invention, each of the sheet body (4), being a tin-plated copper sheet, is integrally formed by punching. In addition, each of the sheet body (4) possesses an opening (41) for containing the central column (221), a groove hole (42), and a pair of pole lead (43) which furnished on both sides of the groove hole (42). The plurality of sheet bodies (4), being mutually laminated and interlaced on the central column (221), is capable of forming a three-directional lead (43) positioned on the second isolator seat (22), and is capable of replacing the coil that is formed by enamel covered wire to achieve the efficacies of saving the space on the low voltage side part (2) and lower the loss caused by Eddy current.

Therefore, the TRANSFORMER HAVING LAMINAR TYPE ON LOW VOLTAGE SIDE of the invention is capable of overcoming the shortcomings of the prior art, satisfying the requirements of the industry, as well as improving the competitiveness in the market.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A transformer having laminar low voltage side, comprising:

a high voltage side part comprising:

a first base seat;

a first isolator seat having a plurality of isolators that divide the first isolator seat into a plurality of isolator grooves, wherein an end of the first isolator seat is connected to the first base seat while another, opposite end of the first isolator seat has a positioning groove; and a plurality of coil sets wound around the first isolator seat, corresponding to and positioned at the plurality of isolator grooves, respectively;

a low voltage side part comprising:

a second base seat;

a second isolator seat having an end connected to the second base seat and another, opposite end defining a central column, wherein the central column is partially positioned in the positioning groove; and a plurality of sheet bodies, each having an opening through which the central column extends, and the plurality of sheet bodies being mutually laminated and interlaced on the central column;

a spacer on the central column, wherein the spacer is positioned, in an axial direction of the transformer, between (i) the end of the first isolator seat which has the positioning groove and (ii) the sheet bodies, the spacer adjusting a spacing between the low voltage side part and the high voltage side part to provide room for various numbers of the sheet bodies.

2. The transformer as claimed in claim 1, wherein, on the low voltage side part, the sheet bodies define the only winding structure of the transformer between the second base seat and the end of the first isolator seat which has the positioning groove.

3. The transformer as claimed in claim 2, wherein the central column has an end surface facing a bottom surface of the positioning groove and spaced from the bottom surface of the positioning groove in the axial direction.

4. The transformer as claimed in claim 2, wherein the central column and the opening of each sheet body have a rectangular shape with rounded corners.

5. The transformer as claimed in claim 2, wherein each sheet body is a tin-plated copper sheet.

6. The transformer as claimed in claim 2, wherein the first isolator seat and the second isolator seat are made of non-electrically-conductive material.

7. The transformer as claimed in claim 2, wherein each of the isolators of the first isolator seat further has at least an open channel that is positioned and communicated between the two isolator grooves on opposite sides of the isolator.

* * * * *